US005439140A

United States Patent [19]

Meyer

[11] Patent Number: 5,439,140

[45] Date of Patent: Aug. 8, 1995

[54] METHOD OF AND APPARATUS FOR DISPENSING BATCHES OF SOAP LATHER

[75] Inventor: Paul Meyer, Kreuzlingen, Switzerland

[73] Assignee: Steiner Company, Inc., Chicago, Ill.

[21] Appl. No.: 342,891

[22] Filed: Nov. 21, 1994

Related U.S. Application Data

[62] Division of Ser. No. 18,735, Feb. 17, 1993, Pat. No. 5,398,845.

[51] Int. Cl.[6] ..... B67D 5/00

[52] U.S. Cl. ..... 222/110; 222/190; 222/209; 222/401

[58] Field of Search ..... 222/190, 109, 110, 181, 222/185, 209, 325, 394, 401, 373; 239/366

[56] References Cited

FOREIGN PATENT DOCUMENTS

| | | |
|---|---|---|
| 731152 | 8/1932 | France . |
| 2517991 | 6/1983 | France . |
| 676227 | 12/1990 | Switzerland . |
| 2193904 | 2/1988 | United Kingdom . |

*Primary Examiner*—Andres Kashnikow
*Assistant Examiner*—Lisa Douglas
*Attorney, Agent, or Firm*—Emrich & Dithmar

[57] ABSTRACT

A dispenser for soap lather has a vessel for a larger supply of liquid soap and a tank for a smaller supply of liquid soap and for a body of air above the smaller supply. One or more bellows are used to pump compressed air into a portion of the tank when a user desires to obtain a batch of lather. The compressed air expels a certain quantity of liquid soap from the tank into a lather generator and the lather generator further receives some compressed air to form a batch of lather which is dispensed into or onto the hands of a user. When the bellows expands or expand it or they can draw air into or along the outlet of the lather generator to retract any remnants of lather. Alternatively, a discrete pump can be provided to blow out any remnants from the lather generator in response to or during expansion of the bellows. The discharged quantity of liquid soap is replenished in the tank by way of an adjustable conduit connecting the vessel with the tank.

3 Claims, 7 Drawing Sheets

METHOD OF AND APPARATUS FOR DISPENSING BATCHES OF SOAP LATHER

This is a divisional of application Ser. No. 08/018,735, filed Feb. 17, 1993 now U.S. Pat. No. 5,398,845 which claims priority of Swiss Application Nos. 00530/92 filed Feb. 21, 1992 and 00043/93 filed Jan. 7, 1993.

BACKGROUND OF THE INVENTION

The present invention relates to improvements in methods of dispensing soap and to improvements in soap dispensing apparatus.

It is known to install manually operable dispensers for liquid soap in public lavatories and like establishments. As a rule, a dispenser for liquid soap is equipped with a pivotable lever whose manipulation results in dispensing of a certain quantity of liquid soap into the palm or onto the back of a hand which must be placed beneath the outlet of a spout for evacuation of liquid soap. A drawback of such dispensers for liquid soap is that droplets of liquid soap are frequently discharged by the spout after the lever is released and after the hand which collects the major part of the quantity of dispensed liquid soap is already removed from a receiving position beneath the spout. The droplets of liquid soap gather in a sink or on the floor and must be collected from time to time in order to enhance the appearance of the lavatory and/or to avoid the likelihood of injury to persons using such facilities. Dispensers of the above outlined character are often installed in rest rooms including those in schools, restaurants, airline terminals, government buildings, office buildings and many others.

In order to eliminate the problems which arise as a result of dripping of liquid soap from liquid soap dispensers, it was already proposed to dispense batches of soap lather, i.e., a mixture of liquid soap and bubbles of air. Reference may be had, for example, to European Pat. No. 0 019 582 which discloses a dispenser embodying a lather generator wherein liquid soap and air are converted into soap lather and which discharges a batch of lather in response to pivoting of a lever. The dispenser of the European patent comprises a vessel for liquid soap and a lather generator defining a cylindrical space which receives liquid soap from the vessel. A metering pump which employs a reciprocable piston is provided to expel liquid soap from the cylindrical space into a mixing chamber. The latter is connected with a diaphragm pump which can be actuated by a lever simultaneously with the metering pump. When the lever is pivoted by a person who desires to wash her or his hands, the lever causes the metering pump to expel liquid soap from the cylindrical space into the mixing chamber (the cylindrical space was filled with liquid soap). Such liquid soap cannot return into the cylindrical space because the patented dispenser employs a check valve which prevents the flow of liquid soap from the metering chamber back into the cylindrical space. A restoring spring thereupon automatically pivots the lever back to its starting position which, in turn, causes the diaphragm pump to force air into the mixing chamber whereby the admitted air forms large bubbles and the contents of the mixing chamber are converted into a mixture of air and liquid soap. The mixture is expelled from the mixing chamber through a porous partition and into an expansion chamber, and the resulting fine lather (containing small bubbles of air) is discharged into or onto the hands of the person awaiting the issuance of a batch of lather.

A drawback of the patented dispenser for soap lather is that the consistency of lather varies within a rather wide range. This is believed to be attributable to the fact that the conditions for the making of lather vary with time, primarily because liquid soap must be conveyed through and tends to deposit in narrow conduits and the initially obtained mixture of air and liquid soap must pass through a porous partition which becomes clogged as a result of repeated use. This entails pronounced changes of pressure and equally pronounced changes of the ratio of liquid soap to air in the mixing chamber as well as in the expansion chamber of the patented lather dispenser. The only presently known solution to overcome the problems in connection with the utilization of the patented lather dispenser is to resort to frequent cleaning which contributes significantly to maintenance cost and renders the patented dispenser less desirable for many applications. Moreover, the patented dispenser is expensive because it must be equipped with different types of pumps and cannot guarantee complete expulsion of a freshly gathered batch of lather from the expansion chamber.

OBJECTS OF THE INVENTION

An object of the invention is to provide a novel and improved method of dispensing batches of soap lather.

Another object of the invention is to provide a method which renders it possible to dispense accurately metered quantities of lather irrespective of the quantity of liquid soap in the dispenser.

A further object of the invention is to provide a method which is simpler than heretofore known methods and which renders it possible to repeatedly dispense batches of identical consistency.

An additional object of the invention is to provide a method which renders it possible to convert liquid soap and a gaseous fluid (normally air and hereinafter referred to as air) in a simple and time saving operation involving a single step.

Still another object of the invention is to provide a method which renders it possible to completely evacuate a freshly formed batch of soap lather so that remnants of batches are not likely to contaminate a sink or the floor in the establishment in which the dispenser for the practice of such method is put to use.

A further object of the invention is to provide a novel and improved soap lather dispenser for the practice of the above outlined method.

Another object of the invention is to provide the dispenser with novel and improved means for ensuring that each of a short or long series of consecutively formed batches of lather is of the same consistency.

An additional object of the invention is to provide novel and improved air compressing means for use in the above outlined dispenser.

Still another object of the invention is to provide the dispenser with a novel and improved no-drip feature.

A further object of the invention is to provide a dispenser wherein the quality of lather is not dependent upon the quantity of liquid soap.

Another object of the invention is to provide a dispenser which requires a minimum of maintenance.

An additional object of the invention is to provide a dispenser which can be readily adjusted to select the quantity of lather in successive batches.

Still another object of the invention is to provide the dispenser with novel and improved means for metering quantities of liquid soap which are to be used in successively formed batches of lather.

SUMMARY OF THE INVENTION

One feature of the present invention resides in the provision of a method of discharging batches of lather from a soap dispenser. The improved method comprises the steps of confining a first supply of liquid soap in a first vessel of the dispenser, confining a second supply of liquid soap in a second vessel of the dispenser beneath a body of air, repeatedly raising the pressure of the body of air to thus expel successive quantities of liquid soap from the second vessel into a mixing chamber of the dispenser and simultaneously admitting into the mixing chamber compressed air to form successive batches of lather and expelling successive batches of lather from the mixing chamber, and replenishing the second supply of liquid soap from the first supply following each pressure raising step.

The admitting step can include conveying compressed air from the body of air in the second vessel into the mixing chamber.

The replenishing step can include refilling the second vessel with liquid soap to a predetermined level.

The method can further comprise the step of metering successive quantities of liquid soap between the second vessel and the mixing chamber.

Another feature of the present invention resides in the provision of a dispenser for batches of lather. The dispenser comprises first and second vessels for first and second supplies of liquid soap. The second vessel includes a lower portion for the second supply, an upper portion for a body of air, and a first outlet which is in communication with the lower portion. The dispenser further comprises a lather generator which is connected with the lower portion of the second vessel through the first outlet and defines a mixing chamber having a second outlet, means for repeatedly compressing the body of air in the upper portion of the second vessel to thus expel successive quantities of liquid soap from the second supply into the mixing chamber through the first outlet and to admit compressed air into the mixing chamber to form successive batches of lather which is expelled through the second outlet, and means for replenishing the second supply from the first supply upon each expulsion of a quantity of liquid soap from the second vessel.

The means for repeatedly compressing preferably comprises at least one pump and means for actuating the at least one pump to thereby raise the pressure of the body of air in the upper portion of the second vessel. The replenishing means can comprise a conduit having an intake end connected with the first vessel and a discharge end for admission of liquid soap into the second vessel at a predetermined level. It is presently preferred to install the second vessel below the first vessel and have the conduit extend downwardly through the upper portion of the second vessel. The discharge end of such conduit then establishes a boundary between the second supply of liquid soap and the body of air in the second vessel.

In accordance with one presently preferred embodiment, the second vessel is provided with a nipple which communicates with the upper portion of the second vessel, and the lather generator is carried by the nipple. The lather generator can comprise a pipe having an intake end which constitutes the first outlet and dips into the second supply of liquid soap. The discharge end of the conduit forming part of the lather generator is surrounded by the body of air in the upper portion of the second vessel.

The dispenser can further comprise means for metering liquid soap between the first outlet and the mixing chamber. The second vessel of such dispenser can include a check valve which is provided in or at the first outlet and serves to prevent return flow of liquid soap from the metering means into the second vessel. The metering means can comprise a pipe having an intake end in the lower portion of the second vessel and a second end carrying the lather generator. The intake end of the pipe forming part of the metering means is located at a level below the second end and the intake end can constitute the first outlet. The aforementioned check valve then serves to prevent return flow of liquid soap from the pipe into the second vessel. The compressing means of the just discussed dispenser further comprises a conduit which connects the at least one pump with the upper portion of the second vessel, and a check valve which is provided in the conduit to prevent return flow of air from the upper portion of the second vessel into the conduit. The discharge end of such conduit can communicate with the second end of the pipe forming part of the metering means, and the metering means preferably further comprises a check valve which is installed between the conduit leading to the at least one pump and the pipe of the metering means to prevent return flow of air from the pipe into the conduit. The lather generator of such dispenser preferably further comprises a casing for the mixing chamber and the second outlet is then provided in such casing. The latter establishes a path for the flow of air into the conduit leading to the at least one pump so that the at least one pump can draw lather back into the mixing chamber or into the casing when the step of raising the pressure of the body of air is completed. The casing can be provided with a check valve which prevents the flow of compressed air from the conduit leading to the at least one pump into the aforementioned path during admission of compressed air into the upper portion of the second vessel. The casing can define a compartment which communicates with the conduit leading to the at least one pump, and the check valve of the casing can be installed in the compartment. A second check valve of the casing is installed in the compartment to prevent the flow of air from the upper portion of the second vessel into the conduit leading to the at least one pump when such conduit receives air from the path through the other of the two check valves in the casing.

The aforementioned actuating means for the at least one pump of the air compressing means can comprise a pivotable lever, a mobile operating member which is connected to the at least one pump, and resilient means (e.g., one or more coil springs) for moving the operating member in response to pivoting of the lever (e.g., by hand).

In accordance with another presently preferred embodiment, the means for repeatedly compressing comprises at least one first pump and first conduit means connecting the at least one first pump with the upper portion of the second vessel, and the dispenser further comprises means for blowing away eventual remnants of lather from the second outlet; such means for blowing away can comprise at least one second pump and second conduit means connecting the at least one second pump with the second outlet. The means for actuating the first and second pumps can comprise a lever which is pivotable about a predetermined axis and is operatively connected with the first and second pumps. The first and second pumps can be installed in the housing of the dispenser in such a way that they are mirror images of each other with reference to a plane including the predetermined axis. The lever can include at least one plate.

The at least one first or second pump can comprise an expandible and contractible or collapsible bellows. The at least one lever is then operative to collapse the bellows in order to force compressed air into the upper portion of the second vessel or into the second outlet, and the dispenser can further comprise resilient means serving to oppose collapsing of the bellows by the at least one lever, i.e, the bellows expands as soon as the application of a pivoting force to the lever is terminated or interrupted. This replenishes the supply of air into the bellows for the next admission of compressed air into the body of air in the second vessel or into the second outlet.

The novel features which are considered as characteristic of the invention are set forth in particular in the appended claims. The improved dispenser itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
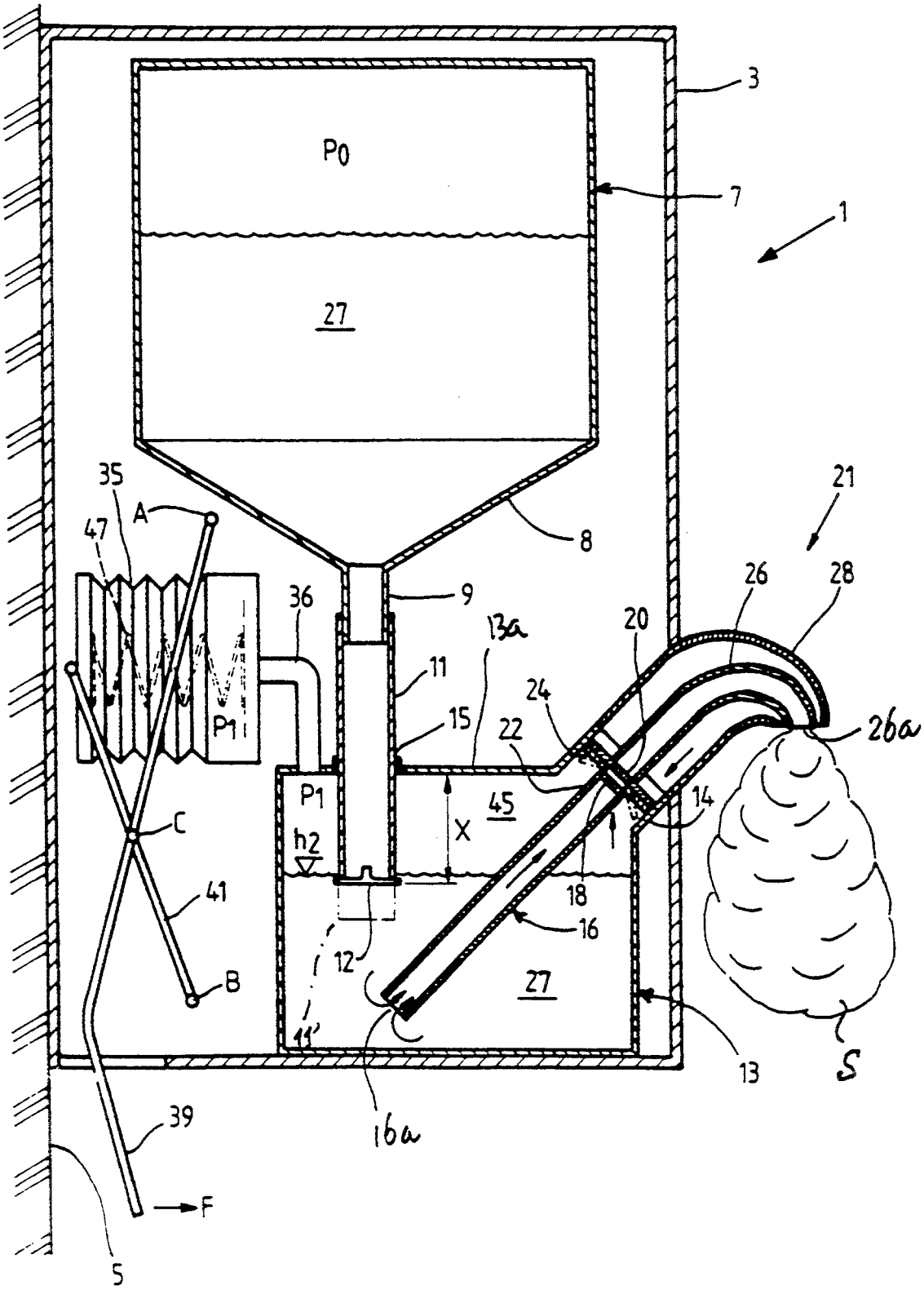
FIG. 1 is a vertical sectional view of a lather dispenser which embodies one form of the present invention and operates without a metering device for liquid soap.

Referring first to FIG. 1, there is shown a lather dispenser 1 including a housing 3 which can be more or less permanently or separably secured to the wall 5 of a supporting structure, e.g., in a lavatory at an airport, rail terminal, bus terminal, educational institution, government building, stadium, hospital, restaurant or any other establishment which is normally visited by large numbers of students, applicants, tourists, guests, customers, inmates or other persons. The housing 3 can be made of a metallic, plastic or other suitable sheet material. The upper portion of the housing 3 confines a relatively large first vessel 7 which contains (or can contain) a relatively large first supply of liquid soap 27. The manner in which the supply of liquid soap 27 in the vessel 7 can be replenished (e.g., through a sealable door at one side or at the top of the housing 3) is not specifically shown in FIG. 1. A smaller second vessel 13 (hereinafter called tank for short) is installed in the housing 3 at a level below the vessel 7 and contains a relatively small second supply of liquid soap 27 which fills the interior of the tank to a level h2. The means for replenishing the supply of liquid soap 27 in the lower portion of the tank 13 comprises a vertically downwardly extending conduit 11 which extends through an opening 15 in the top wall 13*a* of the tank 13 and has a discharge end at the level h2. A check valve 12 (e.g., a conventional diaphragm valve) is provided at the discharge end of the conduit 11 to prevent return flow of liquid soap 27 from the lower portion of the tank 13 into the conduit 11 when the pressure in the upper portion 45 of the tank 13 is raised by a pump 35 in cooperation with a pivotable lever 39.

The vessel 7 has a conical bottom wall 8 which is provided with a centrally located downwardly extending nipple 9 sealingly received in the intake or upper end of the conduit 11. The latter is surrounded by a suitable seal (e.g., one or more O-rings, not specifically shown) in the region (opening 15) where it extends through the top wall 13*a* of the tank 13. The distance X of the valve 12 from the opening 15 can be varied by replacing the illustrated conduit 11 with a shorter or longer conduit or by telescoping the conduit 11 onto the nipple 9 and into the opening 15. A second position of the conduit 11 is indicated in FIG. 1 by phantom lines, as at 11'. It is also possible to replace the illustrated one-piece conduit 11 with a composite conduit containing two or more tubular sections which are slidably telescoped into each other to ensure that the check valve 12 can be moved to a level at any desired distance X from the top wall 13*a* of the tank 13.

The exact construction of the check valve 12 forms no part of the present invention; all that counts is to employ a check valve which does not interfere with the flow of liquid soap 27 from the main or first supply in the vessel 7 into the lower portion of the tank 13 but prevents any return flow of liquid soap into the conduit 11 when the pressure of a body of air in the upper portion 45 of the tank 13 rises in response to admission of additional air through a conduit 36 connecting the pump 35 with the tank 13.

The top wall 13*a* of the tank 13 is of one piece with or is connected to an upwardly extending nipple 14 which carries a lather generator 21. The nipple 14 can be said to constitute a part of the upper portion 45 of the tank 13. The illustrated lather generator 21 can be identical with or can resemble a lather generator of the type described and shown in Swiss Pat. No. 545,232 and comprises a liquid soap supplying pipe 16 having a lower or intake end 16*a* constituting an outlet of the lower portion of the tank 13 and serving to convey liquid soap 27 into a mixing chamber within a lather forming and discharging pipe 26 of the lather generator 21. The upper end of the pipe 16 is located in the nipple 14, i.e., in the upper portion 45 of the tank 13. The upper end of the pipe 16 comprises a transversely extending wall which is provided with a large number of small openings 18 in the form of pores, bores or the like. The end wall at the upper end of the pipe 16 is closely or immediately adjacent a sieve or screen 20 which can include a relatively thin plate of sintered metal and is provided with a large number of minute pores for the flow of liquid soap 27 and air into the mixing chamber within the pipe 26. The tubular part of the upper end portion of the pipe 16 is provided with relatively small passages 22 in the form of bores or holes which admit into the pipe 16 compressed air from the body of air in the upper portion 45 of the tank 13 when the pump 35 is actuated by the lever 39 to discharge air into the upper portion 45 of the tank 13 through the conduit 36. The annular space between a casing or jacket 28 of the lather generator 21 and the pipe 16 upstream of the sieve or filter 20 is normally sealed by an annular membrane 24 which ensures that compressed air which leaves the upper portion 45 of the tank 13 can leave such upper portion only by way of the passages 22 to be mixed with liquid soap 27 rising in the pipe 16 toward the apertures 18 and passing through such apertures toward and through the sieve 20 to enter the mixing chamber in the pipe 26 of the lather generator 21. On the other hand, the membrane 24 permits the inflow of air from the jacket or casing 28 into the upper portion 45 of the tank 13 when the pressure in the upper portion 45 drops below atmospheric pressure.

The pump 35 includes or constitutes an expansible and contractible or collapsible bellows which can be collapsed by a mobile deforming or operating member 41 in response to pivoting of the lever 39 in the direction of arrow F. The lever 39 is pivotable in the housing 3 about a horizontal axis defined by a pivot member A, and the member 41 is pivotable about a second horizontal axis defined by a second pivot member B parallel to the member A. The character C denotes a fulcrum which connects an intermediate portion of the lever 39 with an intermediate portion of the member 41. The latter automatically collapses the bellows of the pump 35 when the lever 39 is pivoted by hand in the direction of arrow F. A spring 47 is installed in the interior of the bellows to expand the latter when the lower end portion of the lever 39 is released. Instead of being installed in the interior of the bellows of the pump 35, the spring 47 (or an equivalent resilient biasing device) can be installed in the housing 3 to bias the lever 39 or the member 41. It is equally possible to employ the illustrated spring 47 jointly with one or more springs which oppose pivoting of the lever 39 in the direction of arrow F and act directly against the lever 39 and/or against the member 41.

The dispenser 1 can be operated as follows:

If a person wishes to utilize a batch of soap lather S, the lever 39 is pivoted in the direction of arrow F, either by hand or by resorting to any suitable implement. The lever 39 pivots the operating member 41 which, in turn, collapses the bellows of the pump 35 against the opposition of the coil spring 47. The member 41 ensures that a relatively small pivotal movement of the lever 39 suffices to expel from the bellows (through conduit 36) a relatively large quantity of air which is used for the making of a batch of lather S and for other purposes. The stream of air which is expelled from the bellows of the pump 35 through the conduit 36 enters the upper portion 45 of the tank 13 and compresses the body of air therein so that the pressure P1 in the upper portion of the tank 13 rises. This causes the body of air in the upper portion 45 to expel liquid soap 27 from the tank 13 through the outlet 16*a* (i.e., into the inlet at the lower or intake end of the pipe 16). The stream of liquid soap 27 which rises in the pipe 16 advances through the openings 18 and through the pores of the sieve 20 to enter the mixing chamber of the pipe 26 forming part of the lather generator 21. Prior to passing through the openings 18, the stream of liquid soap 27 in the pipe 16 is mixed with compressed air which enters from the upper portion 45 of the tank 13 through the passages 22 of the pipe 16. Intensive intermixing of compressed air and liquid soap continues on the way toward, into and in the mixing chamber of the pipe 26, and the resulting lather S is discharged at the outlet 26*a* of the lather generator 21.

The check valve 12 automatically seals the conduit 11 from the interior of the tank 13 when the pressure of the body of air in the upper portion 45 of the tank rises. Thus, a rise of air pressure in the upper portion 45 above atmospheric pressure P0 cannot result in expulsion of liquid soap 27 back toward the vessel 7 but only into the pipe 16 and thence into the mixing chamber of the pipe 26 in the lather generator 21.

When the lever 39 is released so that the spring 47 is free to dissipate energy and to again expand the bellows of the pump 35, the conduit 36 conveys air from the upper portion 45 of the tank 13 back into the bellows so that the pressure P1 of the body of air in the tank 13 decreases. This causes the membrane seal 24 to permit atmospheric air to flow from the interior of the jacket or casing 28 of the lather generator 21 into the upper portion 45 of the tank 13. Thus, the upper portion 45 of the tank 13, the conduit 36 and the expanded bellows of the pump 35 are filled with air at atmospheric pressure. As the pressure P1 in the upper portion 45 of the tank 13 drops, the check valve 12 permits a certain quantity of liquid soap to flow from the vessel 7, through the conduit 11 and into the lower portion of the tank 13 so that the second supply of liquid soap 27 is replenished to the level h2. The admission of liquid soap 27 from the vessel 7 into the tank 13 is terminated when the supply of liquid soap 27 in the lower portion of the tank 13 is restored to the level h2. As already explained hereinbefore, the level h2 can be selected by an operator in that the conduit 11 is moved to the position 11′ or to any other position in order to select a different distance X between the level of the upper surface of the second supply of liquid soap 27 and the top wall 13*a* of the tank 13.

The membrane type seal 24 can be used in combination with, or can be replaced by, other suitable means (e.g., a check valve) which admits atmospheric air into the upper portion 45 of the tank 13 and hence into the conduit 36 and the bellows of the pump 35 when the pressure in the upper portion 45 decreases.

The casing or jacket 28 defines a path for the flow of atmospheric air around the outlet 26*a* and toward the seal 24 to enter the upper portion 45 of the tank 13 when the pressure in the upper portion 45 drops. Such air can entrain eventual remnants of lather S from the outlet 26*a* into the jacket 28 and thence into the tank 13.

Figure 4:
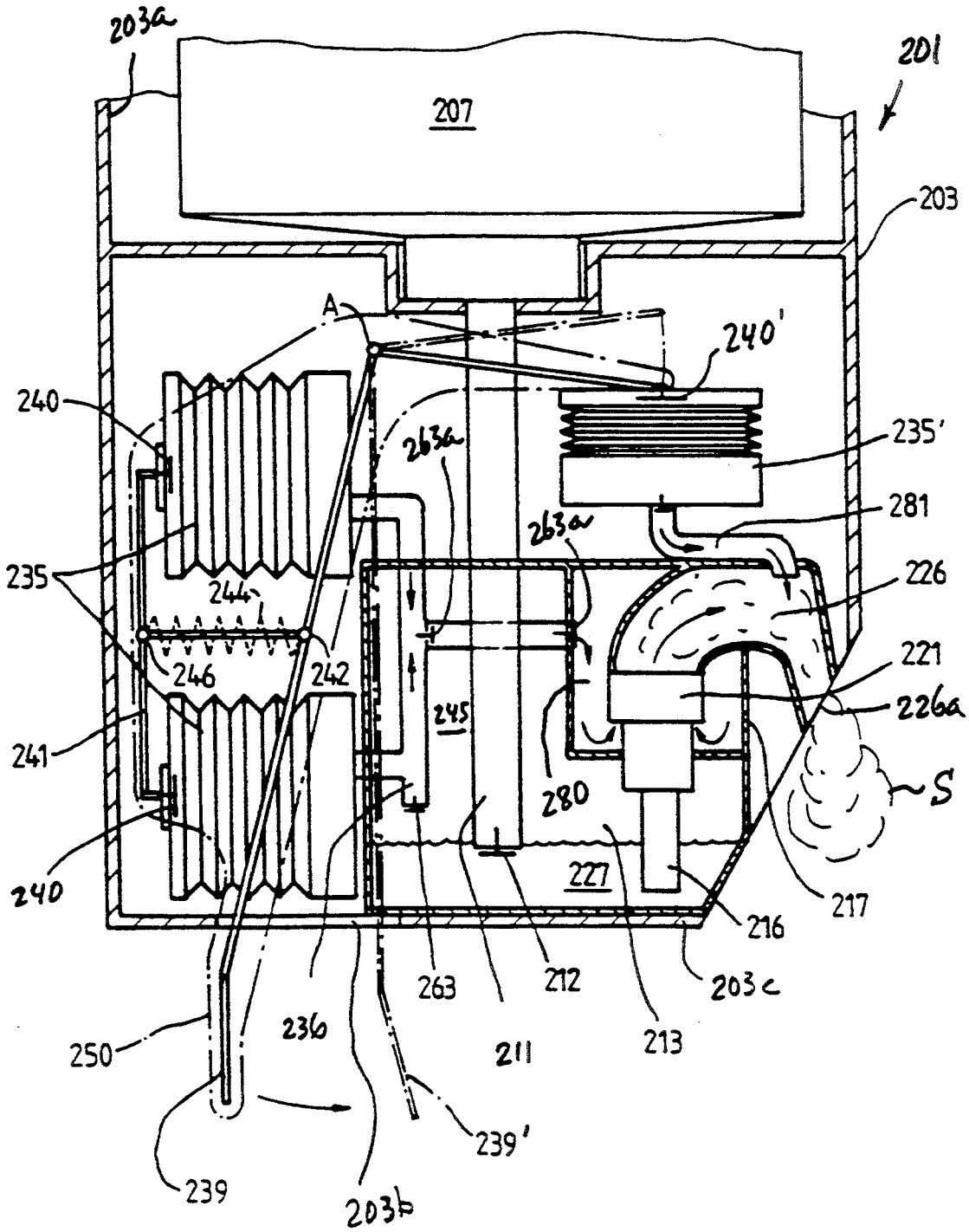
FIG. 4 is a fragmentary vertical sectional view of a third dispenser which is equipped with means for expelling remnants (if any) of successively formed batches of lather from the lather generator.

The pump actuating means including the lever 39 and operating member 41 can be replaced by one or more plate-like levers of the type shown in FIG. 4, as at 250. Such plate-like lever or levers (e.g., one at each side of the pump 35) can have an angular, stellate or other suitable shape. Each such plate-like lever is pivotable at A. If the parts 39 and 41 are replaced by a single plate-like lever or by two levers (one at each side of the pump 35), the extent of compression of the bellows will be somewhat less pronounced, i.e., a smaller quantity of air will be forced into the conduit 36 and thence into the upper portion 45 of the tank 13. If the reduced quantity of air is not sufficient to expel an adequate quantity of liquid soap 27 from the second supply in the tank 13 into the mixing chamber of the pipe 26 and/or to ensure the formation of a satisfactory batch of lather S, the bellows of the pump 35 is replaced with a somewhat larger bellows or the pump 35 can comprise two or more bellows operating in parallel.

An important advantage of the improved dispenser 1 is that it is capable of furnishing successive batches of lather S of optimum and unchanging consistency. This is believed to be attributable primarily to the provision of the tank 13 which contains a relatively small second supply of liquid soap 27 and is designed to deliver successive quantities of liquid soap to the lather generator 21 whenever a person decides to pivot the lever 39 in the direction of arrow F. Each such pivoting of the lever 39 results in expulsion of a certain quantity of liquid soap 27 from the tank 13 as well as in admission of a certain quantity of air from the bellows of the pump 35 into the upper portion 45 of the tank 13. A certain quantity of such air flows into the mixing chamber within the pipe 26 forming part of the lather generator 21 to form with the respective quantity of liquid soap a batch of lather S having a highly satisfactory consistency regardless of the quantity of liquid soap 27 in the vessel 7. The ratio of air to liquid soap 27 in each batch of lather S can be altered by the aforediscussed simple expedient of moving the lower end portion of the conduit 11, and hence the check valve 12, to a different level. For example, such adjustments of the level of the discharge end of the conduit 11 will be carried out in order to take into consideration the quality and viscosity of liquid soap 27.

The lather generator 21 is or can be designed and mounted in such a way that it can be readily detached from the nipple 14 of the tank 13. Such detachment might be necessary from time to time in order to inspect and clean or, if necessary, replace the detached lather generator 21 with a new or with a reconditioned lather generator.

The improved dispenser 1 exhibits the additional advantage that the bellows of the pump 35 can be used to retract remnants (if any) of a batch of lather S when the bellows expands so that liquid soap forming part of such remnant or remnants will not drip into a sink or onto the floor in a lavatory or in any other room in which the dispenser 1 is put to use.

By properly selecting the capacity of the upper portion 45 of the tank 13, one ensures that a relatively small pump 35 suffices to furnish compressed air in quantities which are needed to expel a desired quantity of liquid soap 27 from the lower portion of the tank 13 into the pipe 26 as well as to admit into the pipe 26 a requisite quantity of air to form batches of lather S having a desired consistency and a desired volume.

The lather generator 21 is so simple and can be furnished at such a low cost that a fresh lather generator can be attached to the nipple 14 of the tank 13 at rather frequent intervals without significantly contributing to maintenance cost of the dispenser 1. All other parts of the improved dispenser 1 are also simple and can be mass-produced at a reasonable cost. The only notable deformable component is the bellows of the pump 35 and, in addition to this bellows, the only movable parts are (if necessary) the conduit 11, the check valve 12 and the diaphragm seal 24.

The adjustability of the conduit 11 is a desirable and advantageous but not an absolutely necessary feature of the improved dispenser 1. As explained above, the position of the conduit 11 will be adjusted to account for the quality and viscosity of the liquid soap 27. Such adjustment can also be resorted to in order to change the quantity of lather S in each batch and/or to change the consistency of lather and/or to account for variations of the quality of liquid soap.

As will be explained hereinafter, modifications of the dispenser 1 include the incorporation of features which render it possible to refill the bellows of the pump 35 with air which need not be drawn through the lather generator 21 and/or the upper portion 45 of the tank 13. This even further reduces the likelihood of penetration of liquid soap and/or lather into the bellows of the pump 35. The likelihood of penetration of some lather or liquid soap into the bellows of the pump 35 is more pronounced if the improved dispenser is put to use in an establishment wherein the lever 39 is pivoted at frequent intervals and all day long, e.g., in the lavatories of airline terminals, in schools, prisons, large office buildings and others. The relatively simple dispenser which is shown in FIG. 1 can be put to use in private establishments or in establishments which are visited by rather small numbers of persons. Infrequent use of the dispenser practically eliminates the likelihood of penetration of liquid soap and/or lather into the bellows of the pump 35.

Figure 2:
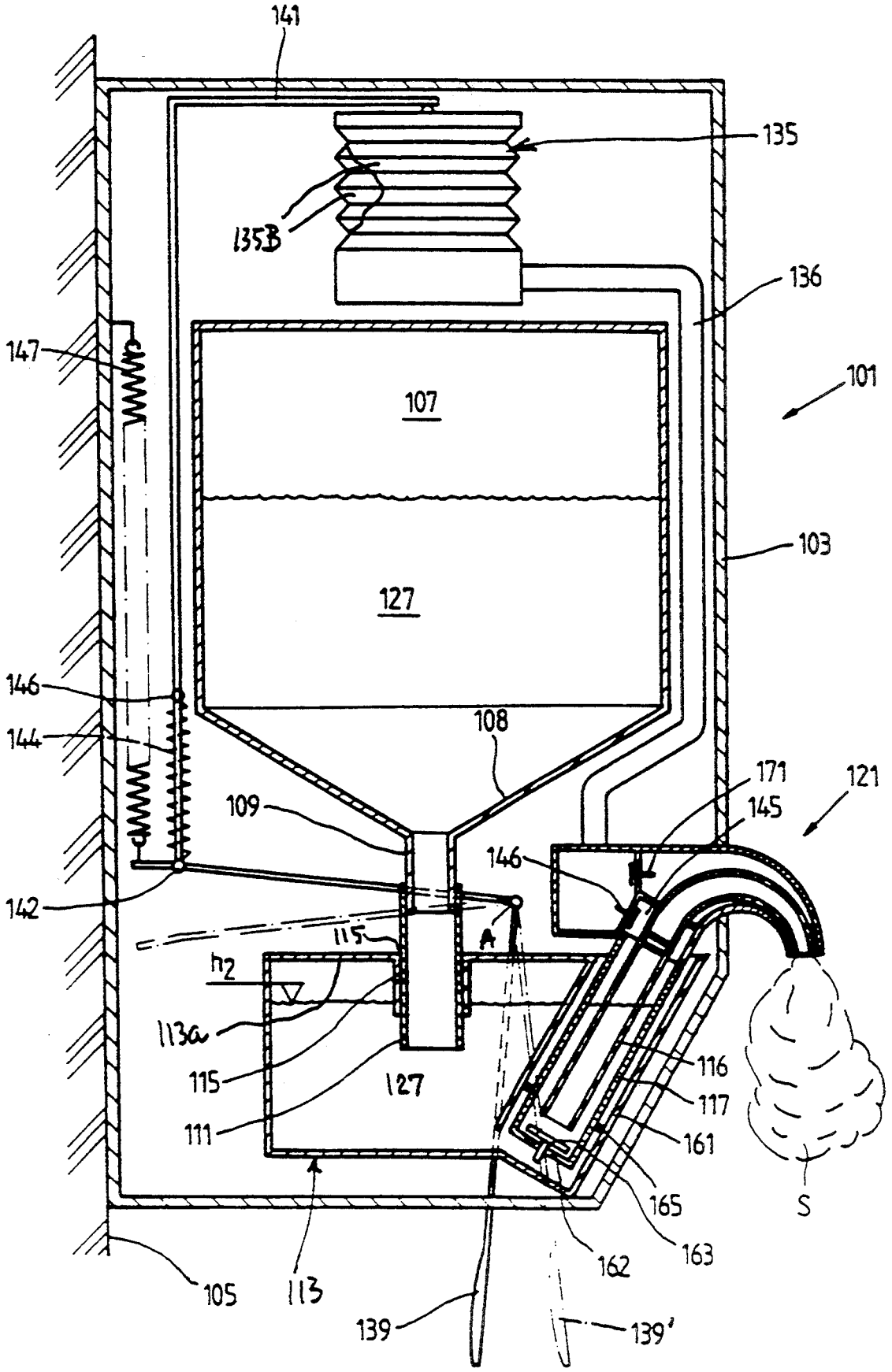
FIG. 2 is a similar vertical sectional view of a second dispenser which employs a metering device between the second vessel and the lather generator.
Figure 3:
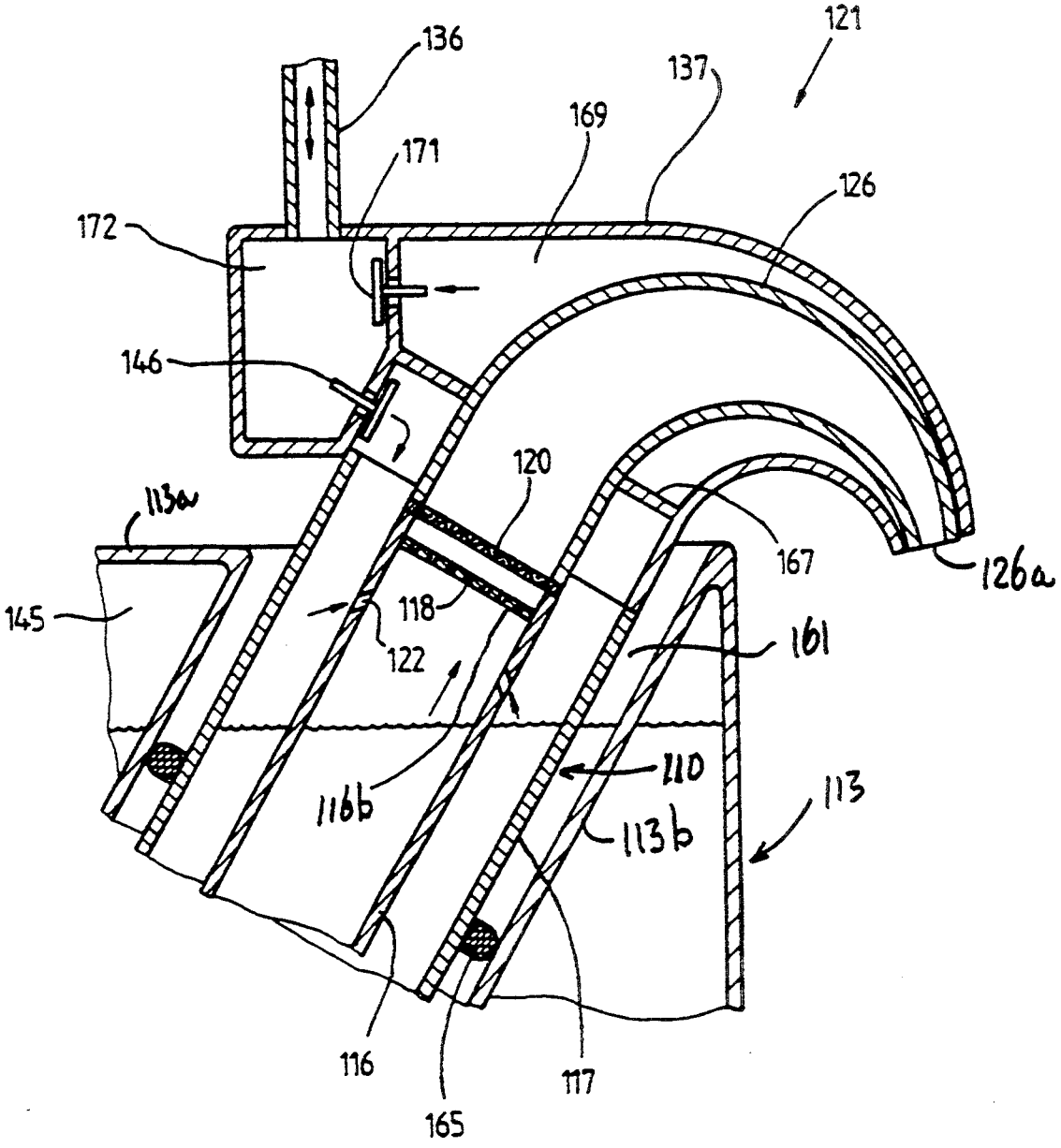
FIG. 3 is an enlarged view of the lather generator in the dispenser of FIG. 2.

FIGS. 2 and 3 illustrate the relevant parts of a second lather dispenser 101. All such parts of this dispenser which are identical with or clearly analogous to corresponding parts of the dispenser 1 of FIG. 1 are denoted by similar reference characters plus 100. The housing 103 of the dispenser 101 is mounted on the wall 105 of a support, e.g., in a lavatory. The vessel 107 for a relatively large first supply of liquid soap 127 is installed in the upper portion, and the tank 113 for a relatively small supply of liquid soap 127 is installed in the lower portion of the housing 103. The conical bottom wall 108 of the vessel 107 has a centrally located nipple 109 which extends into the upper portion of an upright conduit 111 extending through an opening 115 in the top wall **113*a* of the tank 113 to a level h2 between the second supply of liquid soap 127 and the body of air which is entrapped in the upper portion 145 of the tank 113. The tank 113 is provided with a substantially cylindrical recess 161 for a pipe 117 which forms part of a metering device 110 between the outlet of the tank 113 in the bottom wall 162 of the pipe 117 and the mixing chamber in the pipe 126 of the lather generator 121. The latter is mounted on the upper end portion of the pipe 117 of the metering device 110. The outlet of the tank 113 in the bottom wall 162 of the pipe 117 is controlled by a check valve 163 which permits liquid soap 127 to flow from the second supply in the lower portion of the tank 113 into the pipe 117 but not in the opposite direction. The pipe 116 of the lather generator 121 is confined in the pipe 117 of the metering device 110 and has a top end wall 116*b* provided with small openings 118 adjacent a screen or filter 120 with fine pores for admission of air and liquid soap into the mixing chamber of the pipe 126. A sealing element 165 (e.g., an O-ring) is installed between the pipe 117 and the wall 113*b* surrounding the recess 161 of the tank 113. This sealing element is installed at a level below the ports or passages 122 which admit compressed air from the upper portion 145 of the tank 113 into the pipe 116 to mix with liquid soap 127 flowing from the lower end of the pipe 116 toward and through the openings 118 and thereupon toward and through the pores of the sieve or screen 120. A partition 167 seals the upper end of the pipe 117 forming part of the metering device 110. The capacity of the pipe 117 is a fraction of the capacity of the lower portion of the tank 113, i.e., the quantity of liquid soap 127 constituting the second supply (in the tank 113) greatly exceeds the maximum quantity of liquid soap receivable in the pipe 117**.

The bellows of the pump 135 is or are installed in the housing 103 at a level above the vessel 107 and is or are connected with the upper portion 145 of the tank 113 by a conduit 136. The means for actuating the pump 135 includes a two-armed lever 139 which is pivotable in the housing 103, as at A, and can collapse the normally expanded bellows of the pump 135 through the medium of a mobile operating member 141 and a spring 144, e.g., a coil spring which pulls the lower end 146 of the member 141 downwardly in response to pivoting of the lever 139 from the solid-line position to the phantom-line position 139' of FIG. 2. If the spring 144 is omitted, the member 141 is articulately connected to the upper arm of the lever 139 by a pivot member 142 which is parallel to the pivot member A. In other words, the spring 144 can be used in lieu of the pivot member 142 and, therefore, such spring is indicated in FIG. 2 by broken lines. An advantage of the spring 144 is that it ensures a progressive buildup of force which collapses the bellows of the pump 135 in response to pivoting of the lever 139 from the solid-line position to the position 139' of FIG. 2. Furthermore, the spring 144 ensures that the bellows of the pump 135 is or are maintained in collapsed condition for an interval of time following release of the lever 139 by a finger of the person desiring to utilize a batch of lather S.

A second coil spring 147 is provided to permanently bias the lever 139 to the starting position which is indicated in FIG. 2 by solid lines. This permits the bellows of the pump 135 to expand (because the lever 139 lifts the member 141), either due to innate tendency of the bellows to expand or because the right-hand end portion of the member 141 is affixed to the top portion of the bellows and/or because the bellows contains or contain one or more springs (not shown) corresponding to the spring 47 of FIG. 1.

The reference character 137 denotes a casing or jacket which forms part of the lather generator 121 and surrounds the pipe 126. The outlet **126*a* of the pipe 126 discharges from the mixing chamber a batch of lather S in response to the formation of such batch as a result of pivoting of the lever 139 to the position 139'**.

A check valve 146 of the lather generator 121 is installed in a compartment 172 of the casing 137. This valve permits air to flow from the conduit 136 (i.e., from the bellows of the pump 135) into the upper portion 145 of the tank 113 when the member 141 is caused to collapse the bellows. At the same time, a second check valve 171 in the compartment 172 of the casing 137 prevents atmospheric air from flowing along a path 169 (which is defined by the casing 137) from the outlet **126*a* toward and into the conduit 136 and/or into the upper portion 145 of the tank 113. Inversely, when the bellows of the pump 135 is or are caused to expand because the spring 147 is free to dissipate energy, the pressure of air in the compartment 172 drops so that the check valve 146 closes and seals the conduit 136 from the upper portion 145 of the tank 113. At the same time, the check valve 171 opens and permits atmospheric air to flow from the outlet 126*a*, along the path 169, through the compartment 172 and conduit 136 and into the expanding bellows. The exact construction of the check valves 146, 171 forms no part of the invention; for example, at least one of these valves can constitute a simple diaphragm valve which opens in response to the establishment of a pressure differential between the compartment 172 and the upper portion 145 (valve 146) or between the compartment 172 and the path 169 (valve 171**). These valves also close in response to the establishment of a pressure differential but in the opposite direction.

The purpose of the compartment 172 is to collect lather S which is drawn from the outlet **126*a* along the path 169 and through the open check valve 171 while the bellows of the pump 135 expands or expand. The lather which gathers in the compartment 172 decomposes into liquid soap and air; liquid soap returns into the lower portion of the tank 113 through the valve 146 and the upper portion 145, and the separated air is or can be drawn into the bellows of the pump 135 via conduit 136**.

The operation of the dispenser 101 which is shown in FIGS. 2 and 3 is as follows:

The first or main supply of liquid soap 127 in the vessel 107 can be replenished at required intervals by refilling the vessel 107 or by replacing an emptied or partially emptied vessel 107 with a filled vessel. The nipple 109 can be temporarily sealed during insertion of the vessel 107 into the housing 103 and is then unsealed (e.g., by lifting a plug (not shown) into the interior of the properly installed vessel 107) so that liquid soap 127 can flow from the first or main supply through the conduit 111 and forms a second supply in the lower portion of the tank 113. The level h2 can be determined by the body of air in the upper portion 145 of the tank 113; such body is gradually compressed as the level of the supply of liquid soap 127 in the lower portion of the tank 113 rises while the lever 139 is maintained in the solid-line position of FIG. 2. The check valve 163 is then open and permits liquid soap 127 which rises in the lower portion of the tank 113 to rise in the pipe 117 of the metering device 110. The upper level of the supply of liquid soap 127 in the pipe 117 is the same as that (h2) in the tank 113.

If a person desiring to obtain a batch of lather S pivots the lever 139 to the position 139' of FIG. 2, the operating member 141 is caused to collapse the bellows of the pump 135 so that an air stream flows from the interior of the bellows, through the conduit 136 and into the compartment 172 of the casing 137. The coil spring 147 stores energy (or stores additional energy) in response to collapsing of the bellows of the pump 135. In order to ensure that a small angular displacement of the lever 139 from the solid-line position to the position 139' of FIG. 2 will suffice to supply an adequate quantity of air into the upper portion 145 of the tank 113, the illustrated bellows of the pump 135 can be replaced by larger bellows or by a battery of two or more simultaneously collapsible and expansible bellows. For example, the pump 135 of FIG. 2 can comprise two bellows 135B which are disposed one behind the other.

The check valve 146 opens in response to rising pressure in the compartment 172 and permits compressed air to flow from the conduit 136 into the upper portion 145 of the tank 113 as well as through the ports 122 and into the mass of liquid soap 127 in the pipe 116A. As the pressure in the upper portion 145 of the tank 113 rises, a quantity of liquid soap 127 is expelled from the lower portion of the tank through the check valve 163 and into the metering device 110. Lather is generated as a result of mixing of air, which is admitted via passages or ports 122, and liquid soap 127 in the pipe 116, as a result of penetration of liquid soap and air through the minute openings 118 and thereupon through the pores of the sieve or screen 120 to enter the mixing chamber of the pipe 126 where the mixture expands and forms a batch of lather S which leaves the pipe 126 via outlet 126*a* to descend into or onto the hands of a person desiring to use a batch of lather.

The coil spring 147 contracts when the lever 139 is released so that it can pivot back from the position 139' to the solid-line position of FIG. 2. The bellows 135B expand and draw air from the conduit 136 and compartment 172. This results in closing of the check valve 146 and in simultaneous or practically simultaneous opening of the check valve 171 so that a stream of atmospheric air can flow from around the outlet 126*a*, along the path 169, through the compartment 172 and conduit 136 and into the expanding bellows 135B. The check valve 146 is then closed and any lather S which is drawn into the compartment 172 decomposes into air and liquid soap 127 in a manner as already described above. Decomposition of lather in the compartment 172 takes place between two successive actuations of the lever 139; the next-following actuation results in renewed opening of the valve 146 so that air can be forced into the upper portion 145 and recovered liquid soap can be returned into the lower portion of the tank 113.

An advantage of the pump 135 whose bellows 135B is or are located at a level above the vessel 107 is that such pump is remote from the compartment 172. Therefore, any lather S which happens to be drawn into the compartment 172 through the valve 171 in response to expansion of the bellows 135B is highly unlikely to rise all the way into and to contaminate the interior of the bellows. Decomposition of lather in the compartment 172 is desirable on the additional ground that lather cannot descend into the upper portion 145 of the tank 113; this could cause foaming of the supply of liquid soap 127 which is confined in the lower portion of the tank 113.

It is clear that the expanding bellows 135B need not receive air through the casing 137, compartment 172 and conduit 136. For example, a check valve (not shown) can be provided directly in the bellows 135B to open when the bellows expands or expand and to close in automatic response to collapsing of such bellows. Such modification is shown in FIG. 4.

The likelihood of dripping of lather S or liquid soap at the outlet of the lather generator can be further reduced by providing discrete means for blowing away eventual remnants of lather from the outlet of the lather generator as a last stage of the making and dispensing of a batch of lather. A portion of a dispenser 201 which embodies such feature is shown in FIG. 4. All such parts of the dispenser 201 which are identical with or clearly analogous to corresponding parts of the dispenser 1 of FIG. 1 are denoted by similar reference characters plus 200. The housing 203 is separably or more or less permanently affixed to a wall (not shown) in a lavatory or in another room. The rear wall 203*a* of the housing 203 carries or is adjacent two first pumps 235 each of which comprises a bellows and each of which can admit air into a conduit 236 having a first outlet controlled by a check valve 263 and discharging into the upper portion 245 of the tank 213, and a second outlet (controlled by check valves 263*a*) leading into a space 280.

The bellows of the first pumps 235 can be collapsed by a mobile substantially T-shaped deforming or operating member 241 which is articulately connected at 242 to a lever 239 which is pivotable at A. The portion of the operating member 241 between the pivot members 242 and 246 can be replaced by a coil spring 244 which then performs the same function as the spring 144 in the dispenser 101 of FIGS. 2–3. The lever 239 comprises a longer arm which extends from the pivot member A downwardly through a slot 203*b* in the bottom wall 203*c* of the housing 203 and a shorter arm which can deform or collapse the bellows of a second pump 235'. The arrangement is such that the bellows of the pumps 235 are collapsed when the bellows of the pump 235' is expanded and vice versa.

The lather generator 221 of the dispenser 201 is installed in the space 280. The check valves 263 and 263*a* open only when the pressure in the conduit 236 rises but these valves prevent the flow of liquid soap 227 from the lower portion of the tank 213 into the conduit 236 and/or flow of air from the space 280 into the conduit 236 when the bellows of the pumps 235 expand. At such time the bellows of the pumps 235 receive atmospheric air through check valves 240 which close automatically when the operating member 241 is caused to collapse the bellows of the pumps 235. Analogously, the flow of air into the bellows of the pump 235' is controlled by a check valve 240' which closes automatically when the upper arm of the lever 239 is caused to collapse the bellows of the pump 235' so that the latter causes a stream of air to flow in a conduit 281 and into the mixing chamber of the pipe 226 forming part of the lather generator 221. The orientation of the discharge end of the conduit 281 is such that the air stream issuing from this conduit expels traces (if any) of a batch of lather S from the mixing chamber during return movement of the lever 239 from the phantom-line position 239' to the solid-line position of FIG. 4.

A conduit 211 serves to replenish the (second) supply of liquid soap 227 in the lower portion of the tank 213 from the first or main supply in the vessel 207. The lower end portion of the conduit 211 contains a check valve 212 which prevents return flow of liquid soap 227 from the tank 213 into the vessel 207 when the pressure of the body of air in the upper portion 245 rises in response to admission of air from the pumps 235 through the conduit 236 and check valve 263.

The lather generator 221 is or can be similar or analogous to the lather generator 21 or 121 in the dispenser 1 or 101 of FIG. 1 or FIGS. 2–3. The pipe 216 of the lather generator 221 has a lower end which constitutes an outlet for the evacuation of a metered quantity of liquid soap 227 from the lower portion of the tank 213 into the mixing chamber within the pipe 226 of the lather generator 221. The pipe 216 is surrounded by a pipe 217 which can form an integral part of the tank 213.

When the lever 239 is pivoted from the solid-line position to the phantom-line position 239' of FIG. 4, the operating member 241 is caused to collapse the bellows of the pumps 235 and the lever 239 simultaneously causes or permits the bellows of the pump 235' to expand. Compressed air which enters the upper portion 245 of the tank 213 through the check valve 263 in the conduit 236 expels a certain quantity of liquid soap 227 from the lower portion of the tank 213 into the pipe 216.

At the same time, the check valves 263*a* admit compressed air into the space 280, and such air is used to mix with liquid soap 227 in order to form therewith a batch of lather S which leaves the pipe 226 through the outlet 226*a*.

When the lever 239 is released so that it returns from the phantom-line position 239' to the solid-line position of FIG. 4 (e.g., under the action of one or more springs in at least one of the bellows forming part of the pumps 235 and/or under the action of one or more springs acting directly upon the lever 239 and/or operating member 241), the bellows of the pump 235' is caused to collapse and discharges a stream of compressed air into the conduit 281 whose discharge end is located behind but in line with the outlet 226*a* so that any remnants of lather S which continue to fill or partially fill the outlet 226*a* are expelled into or onto the hand or hands of the person desiring to use a batch of lather S.

Figure 4A:
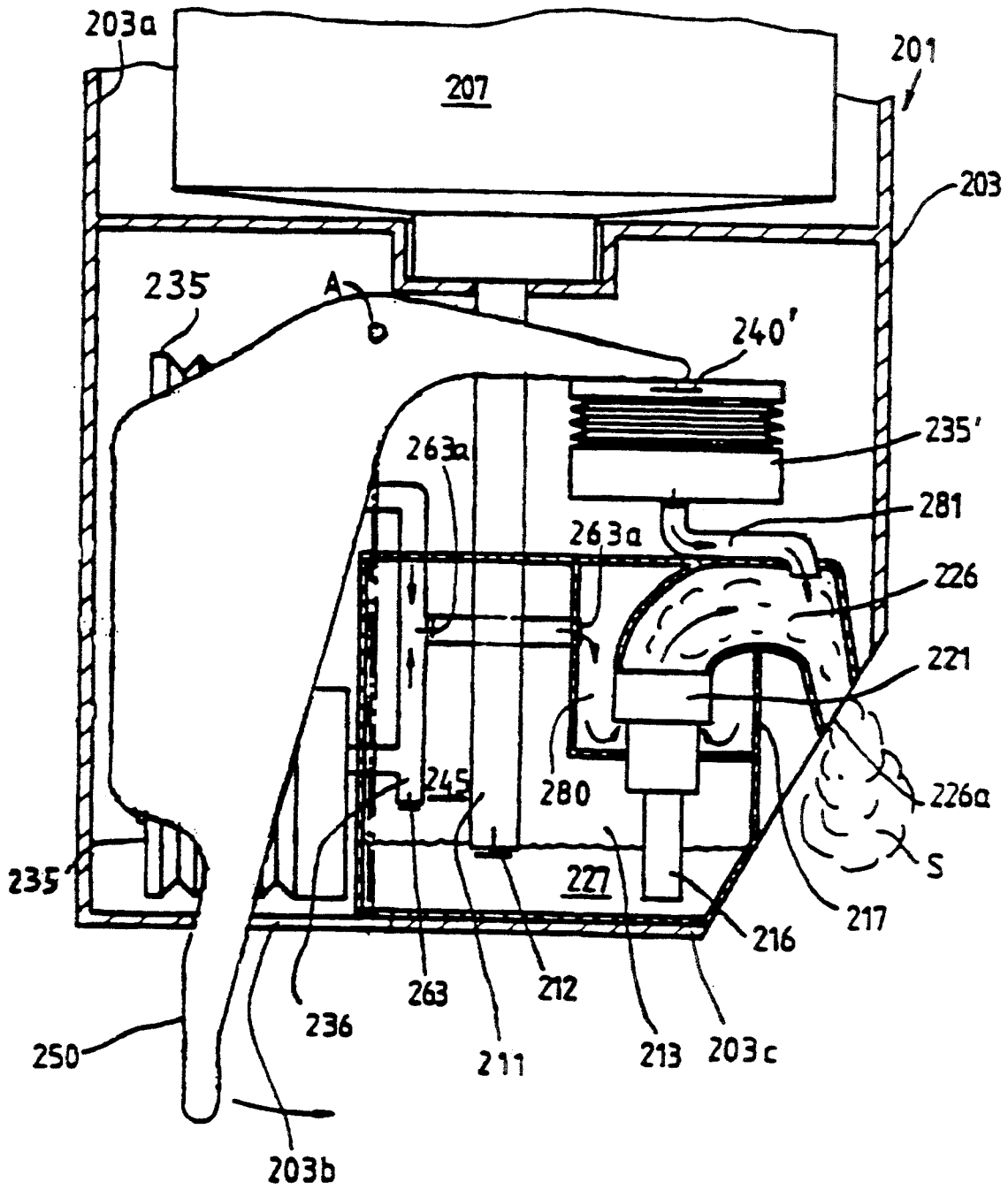
FIG. 4*a* is a fragmentary vertical sectional view of a fifth dispenser which constitutes a modification of the dispenser of FIG. 4.

FIG. 4*a* shows, a plate-like lever 250 which replace the lever 239 and the operating member 241. The lever 250 is fulcrumed at A and includes portions which collapse the bellows of the pumps 235 while permitting or causing the bellows of the pump 235' to expand when the lever 250 is pivoted in a counterclockwise direction from the position which is shown in FIG. 4*a*. Inversely, the lever 250 permits or causes the bellows of the pumps 235 to expand and simultaneously collapses the bellows of the pump 235' when it is caused or permitted to pivot (at A) back to the position which is shown in FIG. 4*a*.

The lever 250 can be used alone or jointly with an identical or similar lever 250. One of these levers is then installed in the housing 203 in front of the pumps 235, 235', vessel 207 and tank 213, and the other lever is installed behind such parts (as viewed in FIG. 4*a*). The two levers 250 can be rigidly connected to each other or they can comprise a common lower portion which extends through the slot 203*b* in the bottom wall 203*c* of the housing 203. Each of the levers 250 can be mounted on a discrete pivot member A which, in turn, is provided on the respective sidewall of the housing 203. The provision of two plate-like levers 250 contributes to stability of the dispenser 201.

Figure 5:
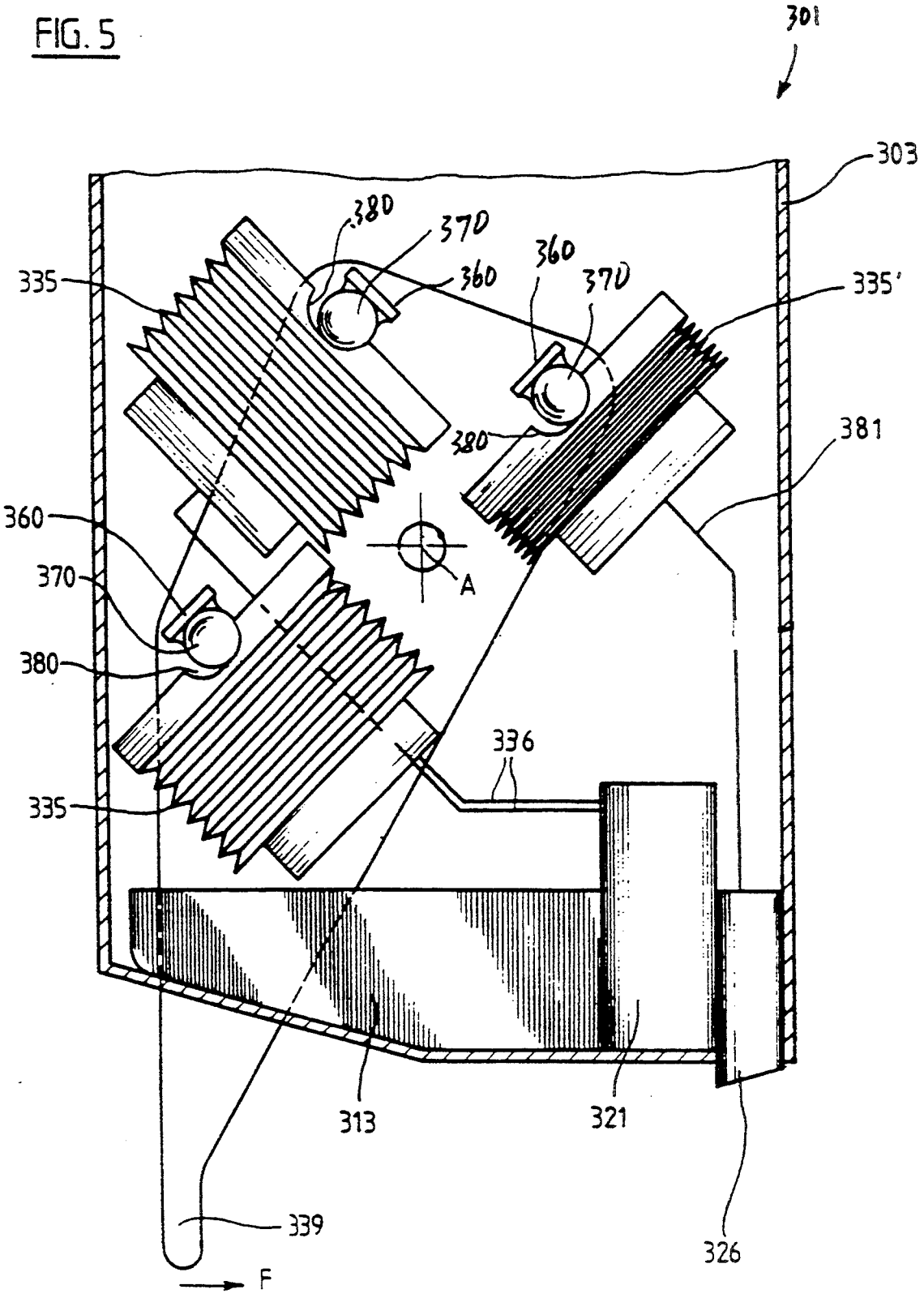
FIG. 5 is a fragmentary vertical sectional view of a fourth dispenser wherein the distribution of various pumps differs from that shown in FIG. 4.
Figure 6:
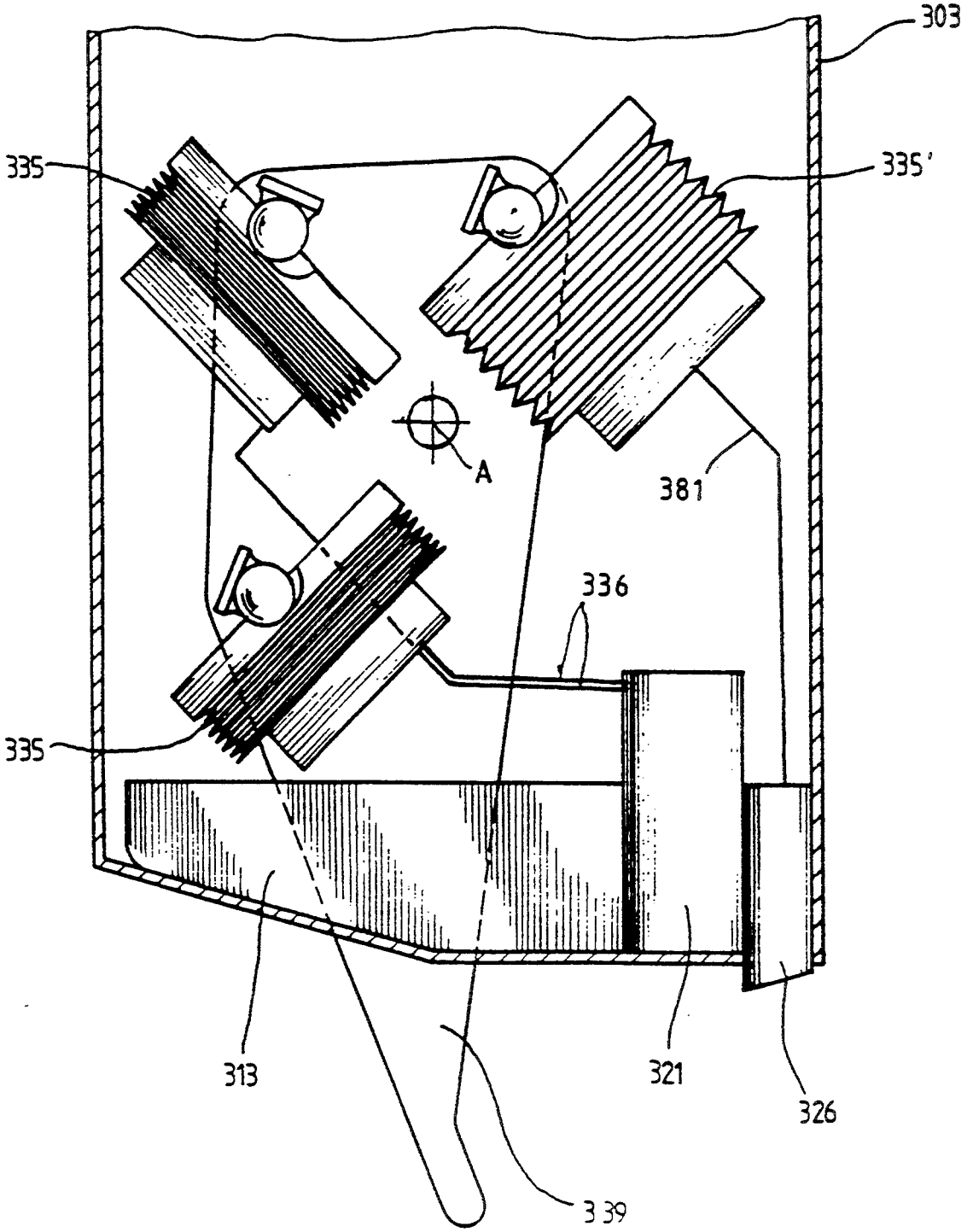
FIG. 6 shows the structure of FIG. 5 but with the pump actuating means in a different position.

FIGS. 5 and 6 illustrate a portion of a fourth dispenser 301 which constitutes a modification of the dispenser 201. A plate-like one-piece lever 339 is fulcrumed in the housing 303 at A and extends downwardly from the housing so that it can be pivoted (e.g., by hand) in the direction of arrow F. Three spaced-apart portions of that part of the lever 339 which is located in the housing 303 carry platform-like supports or carriers 360 for spherical coupling elements 370. Two of the coupling elements 370 extend with a certain amount of play into complementary concave sockets 380 of the bellows forming part of the first pumps 335, and the third spherical coupling element 370 extends with requisite play into a complementary concave socket 380 of the bellows forming part of the pump 335'. FIGS. 5 and 6 further show a conduit 336 which can deliver compressed air into the upper portion of the tank 313 and into the lather generator 321 when the bellows of the pumps 335 are caused to collapse (at such time, the lever 339 permits or causes the bellows of the pump 335' to expand), and a conduit 381 which is analogous to the conduit 281 in the dispenser 201 of FIG. 4.

The illustrated spherical coupling elements 370 and the complementary concave sockets 380 constitute but one of numerous means which can be utilized to transmit motion from the lever 339 to the bellows of the pumps 335 and 335'. Furthermore, the exact manner in which the lather generator 321 makes and discharges batches of lather through the outlet of the pipe 326 can be the same as or analogous to that described in connection with the lather generator 21, 121 or 221.

FIGS. 5 and 6 show that the upper pump 335 and the pump 335' are mirror images of each other with reference to a plane which includes the axis of the pivot member A and is located between the two upper spherical coupling elements 370. As can be seen in FIG. 5, the bellows of the pump 335' is collapsed when the bellows of the pumps 335 are expanded and the lever 339 assumes its starting or idle position. The dispenser 301 is then ready to form and discharge a batch of lather in response to pivoting of the lever 339 in the direction of arrow F. When the lever 339 reaches the other end position (shown in FIG. 6), the bellows of the pumps 335 are collapsed and the bellows of the pump 335' is expanded. The bulk of a batch of lather is already discharged through the outlet of the pipe 326 and the remnant (if any) of such batch is expelled when the lever 339 is released so that it can return from the position of FIG. 6 to the position of FIG. 5 to cause the bellows of the pump 335' to admit compressed air into the conduit 381; such air is admitted into and leaves the outlet of the pipe 326 to expel any remnant of a batch into or onto the hands of the person who has pivoted the lever 339 to the position of FIG. 6. The lever 339 can return to the position of FIG. 5 in response to the bias of a spring in at least one of the pumps 335 and/or in response to the bias of one or more springs acting directly upon the lever 339.

The clearances between the spherical coupling elements 370 and the surfaces bounding the respective concave sockets 380 are desirable but not absolutely necessary. Thus, the bellows of the pumps 335, 335' can undergo sufficient elastic or other deformation to permit the lever 339 to pivot between the positions of FIGS. 5 and 6 even if each spherical coupling element 370 is rather snugly received in the respective socket 380.

The lever 339 of FIGS. 5 and 6 can constitute one of two plate-like actuating members one of which is mounted in front of and the other of which is mounted behind the pumps 335, 335' in a manner as described with reference to the plate-like lever 250 of FIG. 4. Each such lever 339 can be made of relatively thin and weak plate-like metallic or plastic sheet material.

Another important advantage of the dispenser 301 is that the triangular array of pumps 335, 335' renders it possible to employ a compact housing 301. Compactness is desirable and advantageous because this renders it possible to install the parts of the improved dispenser (with or without the housing 3, 103, 203 or 303) in the (emptied) housing of an existing (installed) dispenser.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A dispenser for batches of lather, comprising first, second and third vessels for first, second and third supplies of liquid soap, said second vessel including a lower portion for said second supply, an upper portion for a first body of air and a first outlet for evacuation of liquid soap from said lower portion to said third vessel, said third vessel including a lower portion for said third supply, an upper portion for a second body of air and a second outlet for evacuation of liquid soap from said lower portion of said third vessel; a lather generator fluidly connected to said lower portion of the third vessel through said second outlet and defining a mixing chamber having a third outlet; said second vessel having a nipple in communication with said upper portion thereof and carrying said lather generator; means for repeatedly compressing said second body of air to thus expel successive quantities of liquid soap from said third vessel into said mixing chamber and to admit compressed air from said second body of air into said mixing chamber to form successive batches of lather which are expelled through said third outlet; and means for replenishing said second and third supplies from said first supply by gravity flow from said first vessel upon expulsion of a quantity of liquid soap from said second and third vessels.

2. The dispenser of claim 1, wherein said second vessel has a nipple in communication with said upper portion and said lather generator is carried by said nipple.

3. The dispenser of claim 2, wherein said lather generator comprises a conduit having an intake end constituting said first outlet and dipping into said second supply, and a discharge end in said upper portion.

* * * * *